US006164062A

United States Patent [19]

Blichmann

[11] Patent Number: 6,164,062

[45] Date of Patent: Dec. 26, 2000

[54] EXHAUST SYSTEM FOR AN INTERNAL COMBUSTION ENGINE AND SHIELD ARRANGEMENT THEREFOR

[75] Inventor: John R. Blichmann, Lafayette, Ind.

[73] Assignee: Caterpillar Inc., Peoria, Ill.

[21] Appl. No.: 09/235,713

[22] Filed: Jan. 22, 1999

[51] Int. Cl.[7] ..... F01N 1/00

[52] U.S. Cl. ..... 60/272; 60/322; 180/309; 180/296

[58] Field of Search ..... 60/272, 322, 323; 180/309, 296; 181/211

[56] References Cited

U.S. PATENT DOCUMENTS

| | | | |
|---|---|---|---|
| 3,910,041 | 10/1975 | Gibson . | |
| 3,913,705 | 10/1975 | Sieving . | |
| 3,982,600 | 9/1976 | Gerresheim et al. | 180/69 C |
| 4,029,167 | 6/1977 | Fox et al. . | |
| 4,133,547 | 1/1979 | Fox . | |
| 4,255,928 | 3/1981 | Jones et al. | 60/324 |
| 4,308,930 | 1/1982 | Iida et al. . | |
| 4,343,374 | 8/1982 | Hollandsworth . | |
| 4,471,853 | 9/1984 | Callaghan et al. . | |
| 4,506,749 | 3/1985 | Sieren . | |
| 4,567,956 | 2/1986 | Matsuda et al. | 180/68.1 |
| 4,698,975 | 10/1987 | Tsukamoto et al. | 60/721 |
| 4,719,752 | 1/1988 | Hall . | |
| 4,993,314 | 2/1991 | Braden et al. | 98/58 |
| 5,328,209 | 7/1994 | Cromwell . | |
| 5,570,861 | 11/1996 | Olsen et al. . | |
| 5,832,726 | 11/1998 | Rees et al. | 60/322 |

*Primary Examiner*—Thomas Denion
*Assistant Examiner*—Binh Tran
*Attorney, Agent, or Firm*—Todd T. Taylor

[57] ABSTRACT

An exhaust system for an internal combustion engine includes an enclosure with a top wall having an opening. An exhaust pipe includes an exhaust outlet and an outlet flange which is attached to the pipe at the exhaust outlet. The outlet flange is disposed adjacent to the opening in the enclosure. An exhaust muffler includes an exhaust inlet and an inlet flange which is attached to the muffler at the exhaust inlet. A rain skirt is interposed between and attached to each of the outlet flange of the exhaust pipe and the inlet flange of the exhaust muffler. The rain skirt has a hole therein allowing fluid communication between the exhaust pipe and the exhaust muffler. The rain skirt extends outwardly from the outlet flange and prevents water from entering into the enclosure through the opening.

18 Claims, 2 Drawing Sheets

EXHAUST SYSTEM FOR AN INTERNAL COMBUSTION ENGINE AND SHIELD ARRANGEMENT THEREFOR

TECHNICAL FIELD

The present invention relates to exhaust systems for use with internal combustion engines, and, more particularly, to sealing arrangements for such exhaust systems.

BACKGROUND ART

It is known to provide an enclosure for housing an internal combustion engine for various applications. For example, an internal combustion engine may be disposed within an enclosure which also houses other components of an electrical generator set. The enclosure typically includes grab hooks attached to a top wall thereof which allow the enclosure to be moved from one location to another. The internal combustion engine disposed within the enclosure produces exhaust gases in known matter which must be transported to the ambient environment. An exhaust pipe attached to an exhaust manifold of the internal combustion engine typically extends through an opening formed in a top wall of the enclosure. To prevent water from entering into the enclosure during rain, power washing, etc., it is known to provide a frustroconical shaped rain skirt having a narrow top end which lies closely adjacent to the exhaust pipe. Since sealants cannot be used adjacent to the exhaust pipe because of extreme hot temperatures, water leaks into the enclosure through the small space between the rain skirt and the exhaust pipe.

It is also known to weld the narrow, top end of a frustroconical shaped rain skirt to the exhaust pipe to prevent water from leaking between the rain skirt and the exhaust pipe. However, such additional welding steps require additional time and expense and delay the manufacturing process.

The present invention is directed to overcoming one or more of the problems as set forth above.

DISCLOSURE OF THE INVENTION

In one aspect of the invention, an exhaust system for an internal combustion engine includes an enclosure with a top wall having an opening. An exhaust pipe includes an exhaust outlet and an outlet flange which is attached to the pipe at the exhaust outlet. The outlet flange is disposed adjacent to the opening in the enclosure. An exhaust muffler includes an exhaust inlet and an inlet flange which is attached to the muffler at the exhaust inlet. A rain skirt is interposed between and attached to each of the outlet flange of the exhaust pipe and the inlet flange of the exhaust muffler. The rain skirt has a hole therein allowing fluid communication between the exhaust pipe and the exhaust muffler. The rain skirt extends outwardly from the outlet flange and prevents water from entering into the enclosure through the opening.

In another aspect of the invention, an exhaust shield arrangement is for use in an exhaust system of an internal combustion engine disposed within an enclosure and having an exhaust pipe with an outlet flange and an exhaust muffler with an inlet flange. The exhaust shield arrangement includes a rain skirt having a plate with a hole and a depending flange extending around and transverse to the plate. The rain skirt has a hole therein configured to allow fluid communication between the exhaust pipe and the exhaust muffler. The rain skirt is configured to be interposed between and attached to each of the outlet flange of the exhaust pipe and the inlet flange of the exhaust muffler.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

BEST MODE FOR CARRYING OUT THE INVENTION

Figure 1:
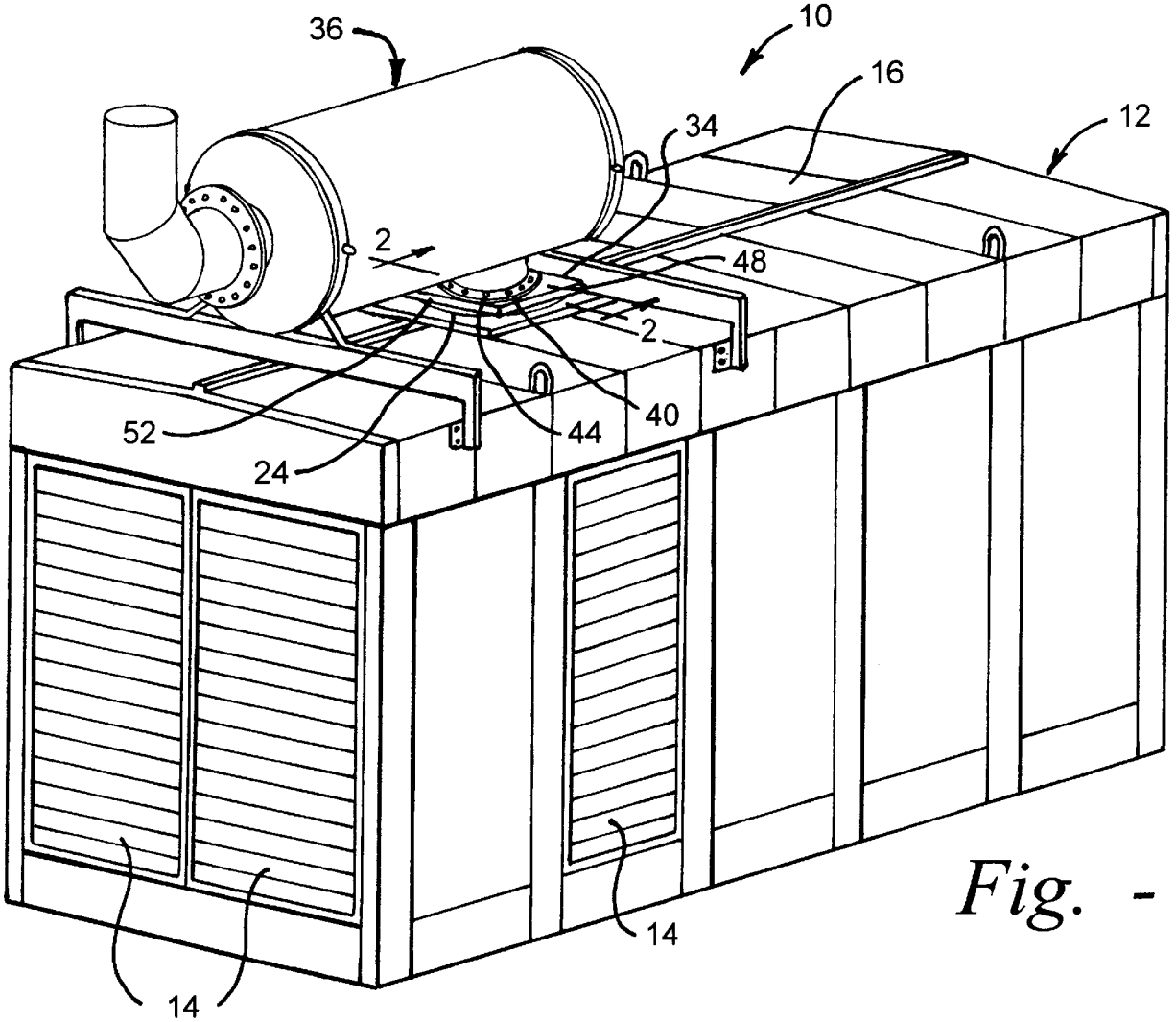
FIG. 1 is a perspective view of an enclosure housing an internal combustion engine with an exhaust system including an embodiment of a rain skirt of the present invention.

Referring now to the drawings, and more particularly to FIG. 1, there is shown an embodiment of an exhaust system 10 of the present invention for use with an internal combustion engine (not shown in FIG. 1) disposed within an enclosure 12. Enclosure 12 can be of any suitable configuration to house an internal combustion engine. For example, enclosure 12 shown in FIG. 1 may house an internal combustion engine which is part of an electric generator set disposed within enclosure 12. Enclosure 12 includes a plurality of louvers 14 which may be automatically controlled, or which open and close upon air flow through enclosure 12 during operation of the internal combustion engine.

Figure 2:
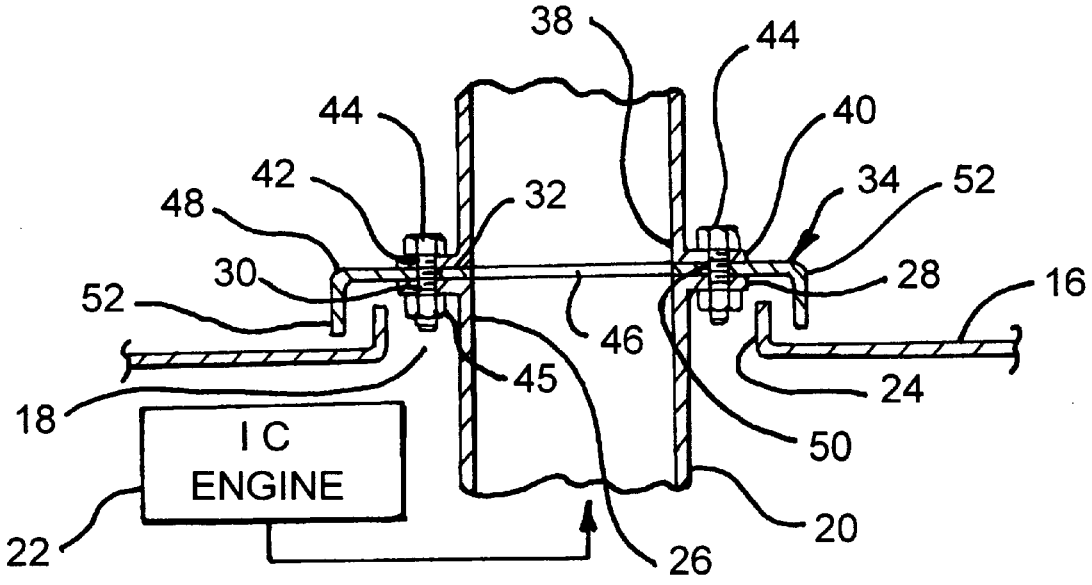
FIG. 2 is a side sectional view taken along line 2—2 in FIG. 1.
Figure 3:
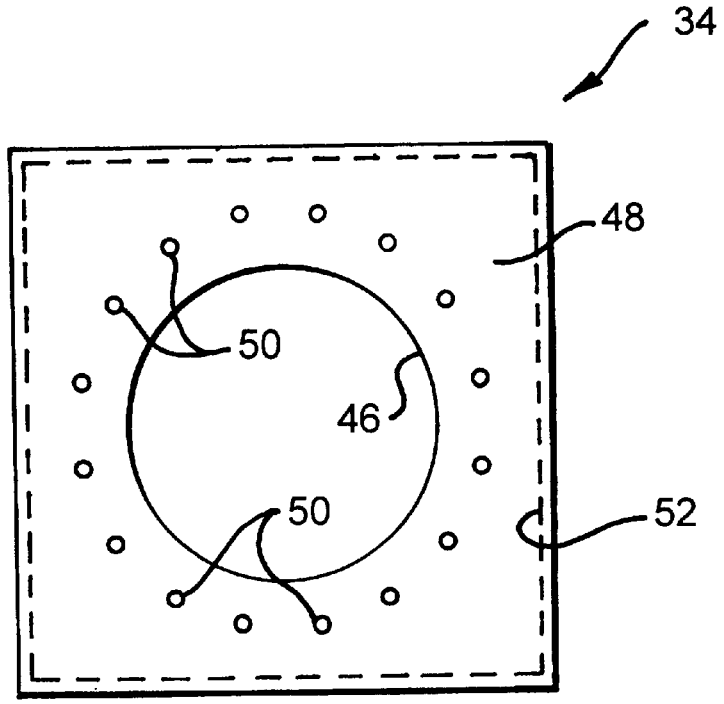
FIG. 3 is a top view of the rain skirt shown in FIGS. 1 and 2.

Referring to FIGS. 1 and 2 conjunctively, enclosure 12 includes a top wall 16 with an opening 18 therein. Opening 18 has a size which is larger than the outside dimensions of an outlet flange 28 of an exhaust pipe 20 which is attached to and extends from the internal combustion engine, shown schematically at block 22 in FIG. 2. In the embodiment shown, exhaust pipe 20 has a circular cross-section and opening 18 has a corresponding circular cross-section with an inside diameter which is larger than the outside diameter of outlet flange 28.

An upwardly extending flange 24 depends from top wall 16 around a periphery of opening 18. Upwardly extending flange 24 may be disposed at any desirable transverse angle relative to top wall 16 which prevents water from flowing into opening 18, and is disposed substantially orthogonal to top wall 16 in the embodiment shown.

Exhaust pipe 20 has an exhaust outlet 26 at an end thereof which is opposite from internal combustion engine 22. Outlet flange 28 is attached to exhaust pipe 20 adjacent to exhaust outlet 26. Outlet flange 28 includes a plurality of bolt holes 30 which are disposed in spaced apart relationship around a periphery of exhaust outlet 26. Outlet flange 28 is substantially annular shaped in the embodiment shown, and surrounds exhaust outlet 26.

Outlet flange 28 has a top surface 32 which is disposed at least slightly above the top of upwardly depending flange 24. Outlet flange 28 thereby positions a rain skirt 34 of the present invention above the top of upwardly depending flange 24, as will be described in more detail hereinafter.

Exhaust muffler 36 includes an exhaust inlet 38 which is disposed in fluid communication with exhaust outlet 26 of exhaust pipe 20. An inlet flange 40 is attached to muffler 36 and surrounds exhaust inlet 38. In the embodiment shown, inlet flange 40 is substantially annular shaped and surrounds exhaust inlet 38. Inlet flange 40 includes a plurality of bolt holes 42 which are spaced apart around a periphery of exhaust inlet 38. Bolt holes 42 are positioned within inlet flange 40 to mate in alignment with bolt holes 30 in outlet flange 28. A plurality of bolts 44 extend through each pair of mating bolt holes 42 and 30 in inlet flange 40 and outlet flange 28, respectively, and engage nuts 45 to interconnect exhaust muffler 36 with exhaust pipe 20. Nuts 45 may be welded to outlet flange 28 so that access to the bottom side of outlet flange 28 is not required. Alternatively, outlet flange 28 may be provided with a plurality of threaded studs (not shown) which extend through bolt holes 42 in inlet flange 40 and threadingly engage with nuts.

According to an aspect of the present invention, rain skirt 34 is interposed between and attached to each of outlet flange 28 and inlet flange 40. Rain skirt 34 has a hole 46 therein which allows fluid communication between exhaust outlet 26 of exhaust pipe 20 and exhaust inlet 38 of exhaust muffler 36. Rain skirt 34 overlies upwardly depending flange 24 and prevents water from entering into enclosure 12 through opening 18.

Rain skirt 34 includes a plate 48 in which hole 46 is formed. A plurality of bolt holes 50 are spaced around the periphery of hole 46 and matingly align with bolt holes 30 and 42 formed in outlet flange 28 and inlet flange 40, respectively. Alternatively, it may be possible to form hole 46 with an inside diameter such that hole 46 lies radially outside of bolts 44 and bolts 44 pass through hole 46. A pair of gaskets (not shown) may be placed on opposite sides of rain skirt 34 adjacent outlet flange 28 and inlet flange 40, respectively.

Rain skirt 34 also includes a flange 52 which depends from plate 48 around a periphery of plate 48. Flange 52 extends transverse to plate 48 to overlie upwardly extending flange 24, and in the embodiment shown is substantially orthogonal to plate 48. The overlapping relationship between downwardly extending flange 52 of rain skirt 34 and upwardly extending flange 24 from top wall 16 prevents water from entering into enclosure 12 through opening 18. In the embodiment shown, plate 48 is substantially square and flange 52 extends downwardly therefrom around the periphery of square plate 48.

INDUSTRIAL APPLICABILITY

To assemble exhaust system 10, outlet pipe 20 is positioned relative to opening 18 in enclosure 12 such that outlet flange 28 is disposed slightly above upwardly depending flange 24 of top wall 16. Rain skirt 34 is positioned on top of outlet flange 28. Exhaust muffler 36 is then positioned on top of rain skirt 34 and mating bolt holes 42, 50 and 30 are aligned in inlet flange 40, rain skirt 34 and outlet flange 28, respectively. Bolts 44 are then passed through the mating bolt holes 42, 50 and 30 and engaged with nuts 45 to clamp exhaust muffler 34 to exhaust pipe 20 with rain skirt 34 interposed therebetween. Plate 48 of rain skirt 34 extends past outlet flange 28 such that downwardly depending flange 52 is disposed radially outside of upwardly depending flange 24 of top wall 16. Rain skirt 34 provides a simple and effective shield to prevent water from flowing into enclosure 12 through opening 18. Rain skirt 34 may be quickly and easily assembled during the normal assembly process of attaching exhaust muffler 36 with exhaust pipe 20 by simply placing rain skirt 34 between outlet flange 28 and inlet flange 40. The assembly process of placing rain skirt 34 between exhaust pipe 20 and exhaust muffler 38 requires little extra time and can be accomplished without additional training or expertise. Rain skirt 34 effectively prevents water from entering into enclosure 12 through opening 18, and does not require additional welding or other time consuming and expensive manufacturing steps to effectively prevent water from entering into enclosure 12.

In the embodiment shown, rain skirt 34 is interposed between outlet flange 28 and inlet flange 40. However, it may also be possible to place rain skirt 34 under outlet flange 28 or above inlet flange 40.

Other aspects, objects and advantages of this invention can be obtained from a study of the drawings, the disclosure and the appended claims.

What is claimed is:

1. An exhaust system for an internal combustion engine, comprising:

an enclosure with a top wall having an opening;

an exhaust pipe with an exhaust outlet and an outlet flange attached to said pipe at said exhaust outlet, said flange disposed adjacent to said opening in said enclosure;

an exhaust muffler with an exhaust inlet and an inlet flange attached to said muffler at said exhaust inlet; and a rain skirt interposed between and attached to each of said outlet flange of said exhaust pipe and said inlet flange of said exhaust muffler, said rain skirt having a hole therein allowing fluid communication between said exhaust pipe and said exhaust muffler, said rain skirt extending outwardly from said outlet flange and preventing water from entering into said enclosure through said opening.

2. The exhaust system of claim 1, wherein said rain skirt includes a plate with said hole, and a depending flange around and transverse to said plate.

3. The exhaust system of claim 2, wherein said flange is orthogonal to said plate.

4. The exhaust system of claim 2, wherein said plate is square.

5. The exhaust system of claim 1, wherein each of said outlet flange, said plate and said inlet flange include a plurality of mating bolt holes, and further comprising a plurality of bolts within said mating bolt holes.

6. The exhaust system of claim 1, wherein said top wall in said enclosure includes an upwardly extending flange around a periphery of said opening.

7. The exhaust system of claim 6, wherein said upwardly extending flange is orthogonal to said top wall.

8. The exhaust system of claim 6, wherein said opening is circular.

9. The exhaust system of claim 1, wherein said outlet flange of said exhaust pipe is disposed slightly above said opening in said top wall.

10. The exhaust system of claim 1, wherein said rain skirt is disposed above said top wall.

11. The exhaust system of claim 1, wherein said rain skirt extends outwardly from each of said outlet flange and said inlet flange.

12. An exhaust shield arrangement in an exhaust system of an internal combustion engine disposed within an enclosure and having an exhaust pipe with an outlet flange and an exhaust muffler with an inlet flange, comprising:

a rain skirt including a plate with a hole and a depending flange extending around and transverse to said plate, said rain skirt having a hole therein configured to allow fluid communication between the exhaust pipe and the exhaust muffler, said rain skirt configured to be interposed between and attached to each of the outlet flange of the exhaust pipe and the inlet flange of the exhaust muffler.

13. The exhaust shield arrangement of claim 12, wherein said flange is orthogonal to said plate.

14. The exhaust shield arrangement of claim 12, wherein said plate is square.

15. The exhaust shield arrangement of claim 12, wherein said plate includes a plurality of bolt holes around said hole.

16. An exhaust system for an internal combustion engine, comprising:

an enclosure with a top wall having an opening;

an exhaust pipe with an exhaust outlet and an outlet flange attached to said pipe at said exhaust outlet, said flange disposed adjacent to said opening in said enclosure;

an exhaust muffler with an exhaust inlet and an inlet flange attached to said muffler at said exhaust inlet; and a rain skirt connected to each of said outlet flange of said exhaust pipe and said inlet flange of said exhaust muffler, said rain skirt having a hole therein which is concentric with at least one of said exhaust outlet and said exhaust inlet, said rain skirt extending outwardly from said outlet flange and preventing water from entering into said enclosure through said opening.

17. The exhaust system of claim 16, wherein said rain skirt is interposed between and attached to each of said outlet flange of said exhaust pipe and said inlet flange of said exhaust muffler, and said hole in said rain skirt allows fluid communication between said exhaust pipe and said exhaust muffler.

18. The exhaust system of claim 16, wherein each of said exhaust outlet and said exhaust inlet have a circular cross section, and said hole in said rain skirt is concentric with each of said exhaust outlet and said exhaust inlet.

* * * * *